US011608707B2

(12) United States Patent
Lende et al.

(10) Patent No.: US 11,608,707 B2
(45) Date of Patent: Mar. 21, 2023

(54) REMOVABLE CORE WIPER PLUG

(71) Applicant: Halliburton Energy Services, Inc., Houston, TX (US)

(72) Inventors: Gunnar Lende, Sola (NO); Tor Saetre, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 17/377,182

(22) Filed: Jul. 15, 2021

(65) Prior Publication Data

US 2021/0340841 A1 Nov. 4, 2021

Related U.S. Application Data

(63) Continuation of application No. 16/638,094, filed as application No. PCT/US2017/057023 on Oct. 17, 2017, now Pat. No. 11,066,900.

(51) Int. Cl.
*E21B 33/16* (2006.01)
*E21B 31/12* (2006.01)

(52) U.S. Cl.
CPC ..... *E21B 33/16* (2013.01); *E21B 31/12* (2013.01)

(58) Field of Classification Search
CPC ..... E21B 33/16; E21B 31/12
See application file for complete search history.

(56) References Cited

U.S. PATENT DOCUMENTS 3,690,379 A 9/1972 Bullen
5,479,986 A 1/1996 Gano et al.
6,945,326 B2 * 9/2005 Mikolajczyk ..... E21B 33/08 166/153
7,350,582 B2 4/2008 McKeachnie et al.
8,905,147 B2 12/2014 Fripp et al.
9,016,388 B2 4/2015 Kellner et al.
9,316,090 B2 4/2016 Walton et al.
9,428,986 B2 8/2016 Hern et al.
9,458,692 B2 10/2016 Fripp et al.
9,506,318 B1 11/2016 Brunet
2011/0000676 A1 1/2011 Brandsdal
2013/0333890 A1 12/2013 Dagenais et al.
2013/0333891 A1 12/2013 Fripp et al.
2014/0190705 A1 7/2014 Fripp et al.
(Continued)

FOREIGN PATENT DOCUMENTS

AU 2014263194 A1 10/2015
AU 2014385213 A1 5/2016
(Continued)

OTHER PUBLICATIONS

International Search Report and Written Opinion in PCT Application No. PCT/US2017/057023, dated Jul. 5, 2018.

*Primary Examiner* — Taras P Bemko
(74) *Attorney, Agent, or Firm* — Barnes & Thornburg, LLP

(57) ABSTRACT

Provided are wiper plugs with removable cores and methods of using the wiper plugs with removable cores. An example wiper plug with a removable core comprises a molded body, a wiper, a cavity through the interior of the molded body, a support disposed in the cavity, and the removable core disposed in the cavity. An example method of use comprises removing the core of the wiper plug without drilling through the wiper plug, and leaving the remainder of the wiper plug in the wellbore.

20 Claims, 12 Drawing Sheets

(56) References Cited

U.S. PATENT DOCUMENTS

| | | | |
|---|---|---|---|
| 2014/0224807 | A1 | 8/2014 | Ramon |
| 2014/0332233 | A1 | 11/2014 | Walton et al. |
| 2014/0338925 | A1 | 11/2014 | Warlick et al. |
| 2014/0345878 | A1 | 11/2014 | Murphree et al. |
| 2015/0068730 | A1 | 3/2015 | Frazier |
| 2015/0167424 | A1 | 6/2015 | Richards et al. |
| 2015/0191986 | A1 | 7/2015 | Deng et al. |
| 2016/0333658 | A1 | 11/2016 | Keshishian et al. |
| 2017/0009532 | A1 | 1/2017 | Wight et al. |
| 2017/0022778 | A1 | 1/2017 | Fripp et al. |
| 2018/0051533 | A1* | 2/2018 | Zbranek ..... E21B 33/134 |
| 2018/0334880 | A1 | 11/2018 | Jones et al. |

FOREIGN PATENT DOCUMENTS

| | | | |
|---|---|---|---|
| AU | 2013274865 | B2 | 7/2016 |
| AU | 2014263194 | B2 | 10/2016 |
| AU | 2014385213 | B2 | 12/2016 |
| AU | 2016203183 | B2 | 3/2018 |
| CA | 2930970 | A1 | 9/2015 |
| EP | 3055487 | A1 | 8/2016 |
| EP | 3058166 | A1 | 8/2016 |
| EP | 3097252 | A1 | 11/2016 |
| EP | 3097255 | A1 | 11/2016 |
| EP | 3500719 | A1 | 6/2019 |
| WO | 2004051049 | A2 | 6/2004 |
| WO | 2010120774 | A1 | 10/2010 |
| WO | 2014100141 | A2 | 6/2014 |
| WO | 2014182355 | A2 | 11/2014 |
| WO | 2014186077 | A1 | 11/2014 |
| WO | 2015130258 | A1 | 9/2015 |
| WO | 2015134074 | A1 | 9/2015 |
| WO | 2016046533 | A1 | 3/2016 |
| WO | 2016122451 | A1 | 8/2016 |
| WO | 2016133846 | A1 | 8/2016 |
| WO | 2016144767 | A1 | 9/2016 |

* cited by examiner

REMOVABLE CORE WIPER PLUG

This Application is a Continuation of application Ser. No. 16/638,094 filed on Feb. 10, 2020, now U.S. Pat. No. 11,066,900, issued Jul. 20, 2021. The entire contents of these applications are incorporated herein by reference in their entirety.

TECHNICAL FIELD

The present disclosure relates to the use of wiper plugs for plugging operations in a wellbore, and more particularly, to the use of a wiper plug comprising a removable core to allow for selectable access to the area downhole of the wiper plug without having to drill away the wiper plug.

BACKGROUND

Wiper plugs, also called cementing plugs, may be used to separate a cement from other fluids during primary cementing operations. In some operations a type of wiper plug referred to as a top plug may be used which may be pumped after the cement/sealant in the tubular. The top plug comprises wipers and follows the cement down the tubular to a landing location. The top plug may be used to reduce the possibility of contamination of the cement/sealant with a subsequently pumped fluid. The top plug may be solid in construction and designed to halt fluid flow downhole of the top plug. After the top plug has been placed, it may sometimes be necessary to determine the top of the cement. For example, it may be necessary to determine and verify if the cement has been properly placed in the tubular or if a portion has leaked out or been contaminated with other fluids present in the tubular before cementing or pumped ahead of the cement during placement. It may also be necessary to determine the strength of the cement barrier. The location of the cement may be determined with a designated tagging device that may be used to locate the top of the cement and also to test the cement by applying pressure. Tagging refers to an operation which implies setting down a force to verify that there is a solid material present preventing further downwards movement. If a wiper plug is present, the tagging device may be unable to contact the cement without going through the wiper plug. As such, the exact location and condition of the cement may be difficult to determine if a wiper plug is uphole of the cement.

Generally, wiper plugs may be drilled through to allow the tagging device to contact the cement. However, in some cases the wellbore equipment may not allow for drilling through the wiper plug (e.g., in operations which lack drilling rigs, snubbing units, and/or coiled tubing). Generally, this includes any operation limited to pumping and/or wireline services. In these instances, the wiper plug may need to be removed another way or the cement may have to be located or tested in an alternative manner which does not require contact through the wiper plug. If the cement cannot be tagged and/or tested, the competency of the cement barrier may not be known which can add risk to further operations. In some jurisdictions, regulations require tagging of the cement in order to approve a plug and abandon operation. As such, failure to achieve a successful tagging may result in the plugging operation failing to be approved.

BRIEF DESCRIPTION OF THE DRAWINGS

Illustrative examples of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different examples may be implemented.

DETAILED DESCRIPTION

The present disclosure relates to the use of wiper plugs for plugging operations in a wellbore, and more particularly, to the use of a wiper plug comprising a removable core to allow for selectable access to the area downhole of the wiper plug without having to drill away the wiper plug.

Examples of the methods and systems described herein comprise the use of a removable core wiper plug. Advantageously, the core of the wiper plug may be removed when desired. Further advantageously, access to the cement/sealant downhole of the wiper plug may be provided when the core of the wiper plug is removed. Moreover, the body of the wiper plug may be designed to provide a diameter for the resulting void left by the removed core that is as large as possible so as to provide adequate space for downhole tools or tagging devices to pass through the wiper plug. The core may be removed using different means, and therefore the type of removal application may be tailored for a specific well to provide an operator with many options for removable core wiper plugs.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

Figure 1:
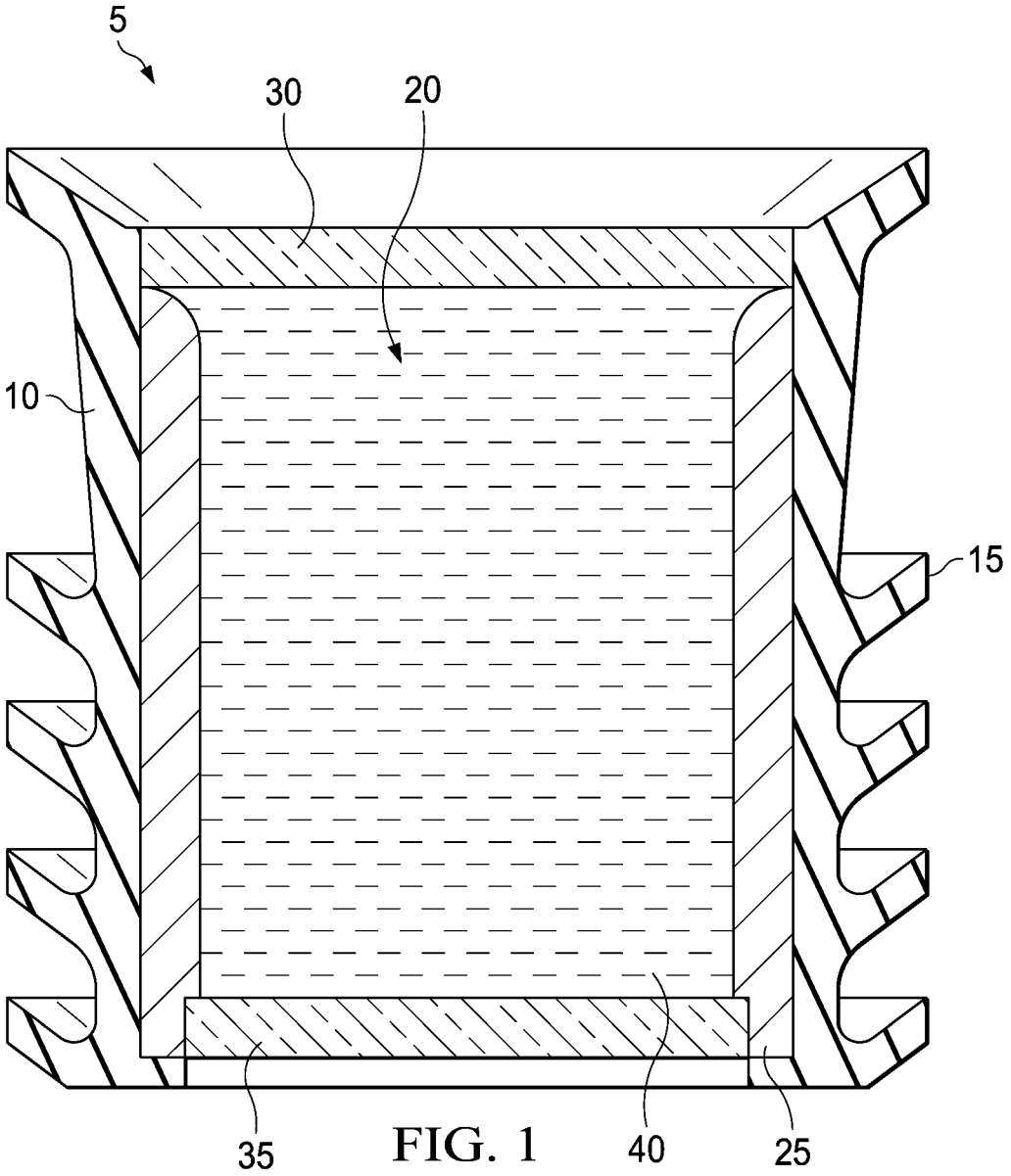
FIG. 1 is a cross-section schematic illustrating an example wiper plug in accordance with the examples disclosed herein.

FIG. 1 is a cross-section schematic illustrating an example wiper plug, generally 5. The wiper plug 5 comprises a molded body 10 having a plurality of exterior wipers 15. The molded body 10 comprises a cavity 20. On the interior of the molded body 10 is a support 25 that provides support to the molded body 10 to prevent it from collapsing. Optionally, the support 25 may be chamfered at the uphole section of the wiper plug 5 to prevent tagging equipment or other downhole tools from being caught on the support 25. In some further optional examples, the bottom of the support 25 may also be chamfered. The sides of the molded body 10 of the wiper plug 5 are designed to comprise as small of a width as possible so as to allow the diameter of the cavity 20 to be as large as possible.

The molded body 10 may comprise any materials sufficient for forming the body of the wiper plug 5. Examples of these materials may include, but are not limited to, rubber and other elastomeric plastics, non-elastomeric plastics, metals, metal alloys, composites thereof, or combinations thereof. The molded body 10 may be molded to comprise any shape sufficient for the wiper plug 5. The exterior wipers 15 may extend from the exterior of molded body 10 and may contact the walls of the wellbore or the walls of any wellbore tubular. The exterior wipers 15 may prevent the passage of fluids across the exterior of the wiper plug 5. The exterior wipers 15 may comprise the same or different materials from the molded body 10.

The support 25 may be shaped to fit within cavity 20 of the molded body 10. The support 25 comprises walls having a width as small as possible so as to allow the diameter of cavity 20 to be as large as possible. The support 25 should be sufficiently strong so as to prevent the collapse of the molded body 10 within the wellbore. Examples of materials for support 25 include plastics, metals, metal alloys, composites thereof, or combinations thereof.

The uphole portion of the wiper plug 5 further comprises an uphole breakable covering 30. The uphole breakable covering 30 comprises a breakable material. The breakable material may be any material that may be broken by impact with a projectile or by force with a suitable device. Examples of breakable materials may include, but are not limited to, toughened glass, annealed glass, ceramics, plastics, cast iron, high carbon steel, brass, metal alloys, composites thereof, or combinations thereof. The breakable material may be shattered or cracked upon contact with the projectile. Alternatively, the breakable material may be punctured upon contact with the projectile. The downhole portion of the wiper plug 5 further comprises a downhole breakable covering 35. The downhole breakable covering 35 comprises the breakable material. The cavity 20, disposed between the uphole breakable covering 30 and the downhole breakable covering 35, comprises a core of a fluid 40 disposed therein. The core fluid 40 may comprise a liquid, gas, or a combination thereof. Examples of the core fluid 40 include, but are not limited to, oleaginous liquids, aqueous fluids, air, greases, gels, or combinations thereof.

When desired for use, a projectile may be released uphole of wiper plug 5. The projectile may travel downhole and contact uphole breakable covering 30. Contact of the projectile and uphole breakable covering 30 may induce the breaking of the breakable material of uphole breakable covering 30. The projectile may then continue to travel through the cavity 20 and the fluid 40 therein until the projectile contacts downhole breakable covering 35. Contact of the projectile and downhole breakable covering 35 may induce breaking of the breakable material of downhole breakable covering 35. With both the uphole breakable covering 30 and the downhole breakable covering 35 broken, the core fluid 40 within cavity 20 may drain from the wiper plug 5, or offer minimal resistance to penetration if any portion is still present. Tagging equipment and other downhole tools may then be able to travel through the openings in the wiper plug 5 and through cavity 20 to access the wellbore zones downhole of the wiper plug 5. In some examples, a cement disposed downhole of wiper plug 5 may be tagged with tagging equipment to determine the location and/or strength of the cement.

Figure 2:
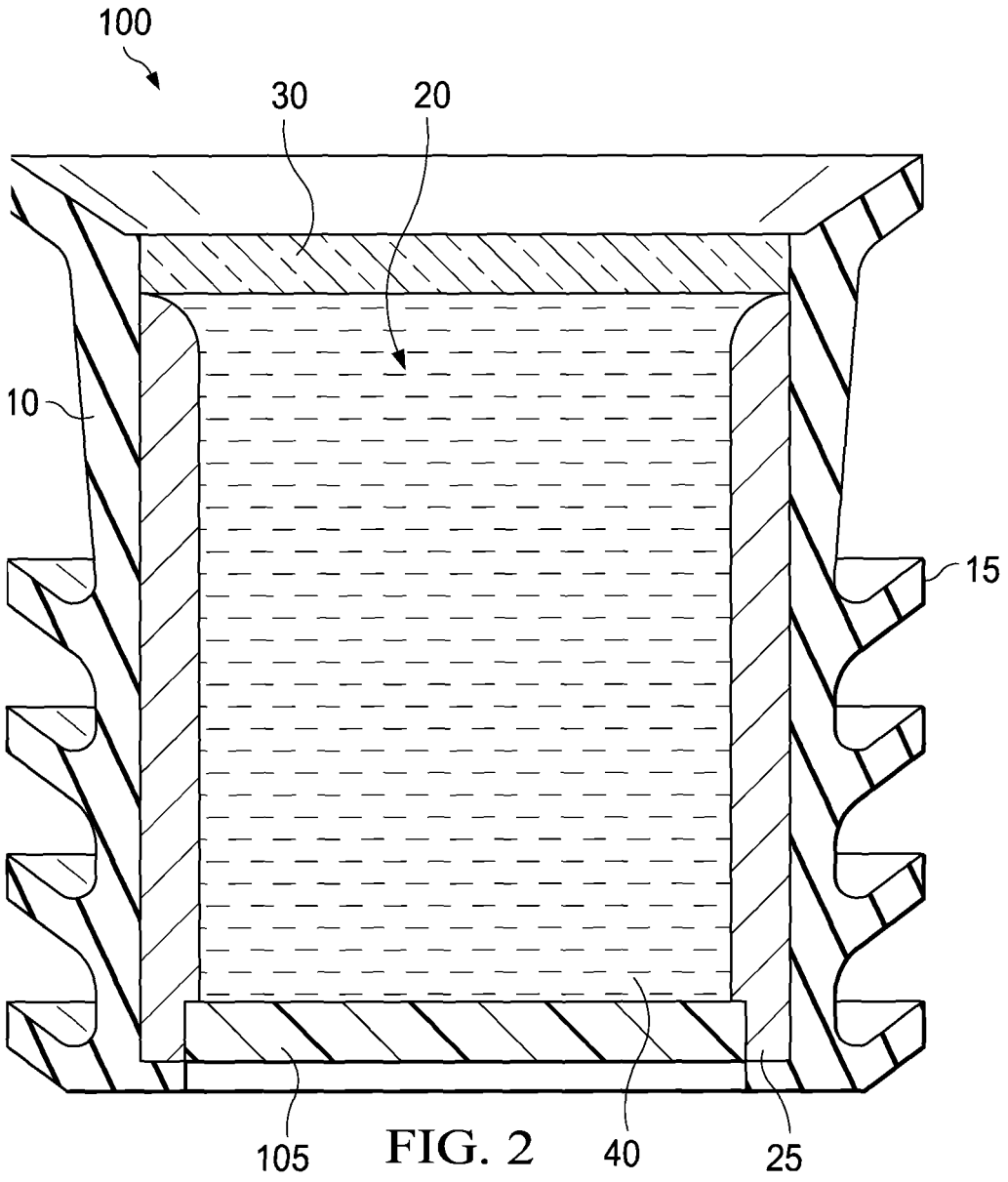
FIG. 2 is a cross-section schematic illustrating another example wiper plug in accordance with the examples disclosed herein.

FIG. 2 is a cross-section schematic illustrating another example wiper plug, generally 100. As with the wiper plug 5 of FIG. 1, wiper plug 100 comprises a molded body 10 having a plurality of exterior wipers 15, a cavity 20, a support 25, an uphole breakable covering 30, and a core comprising a fluid 40 disposed within cavity 20. As described in FIG. 1, the sides of the molded body 10 of the wiper plug 100 are designed to comprise as small of a width as possible so as to allow the diameter of the cavity 20 to be as large as possible.

The wiper plug 100 further comprises a downhole rupturable covering 105. Downhole rupturable covering 105 may comprise any rupturable material or structure that may rupture and fail at a threshold pressure differential. As such, the downhole rupturable covering 105 may fail at a specific wellbore depth or if an increased pressure is applied to the downhole rupturable covering 105 via a fluid or by pressuring up the wellbore via any sufficient pressuring operation. The downhole rupturable covering 105 may be a rupture disc, pressure safety disc, burst disc, bursting disc, burst diaphragm, or more generally, any non-reclosing pressure relief device. The downhole rupturable covering 105 may comprise metal, plastic, or any material or layerable material which may be ruptured by a change in pressure.

When desired for use, a projectile may be released uphole of wiper plug 100. The projectile may travel downhole and contact uphole breakable covering 30. Contact of the projectile and uphole breakable covering 30 may induce the breaking of the breakable material of uphole breakable covering 30. Downhole rupturable covering 105 may be ruptured at any time, including before or after the projectile contacts uphole breakable covering 30. With the uphole breakable covering 30 broken and the downhole rupturable covering 105 ruptured, the core fluid 40 within cavity 20 may drain from wiper plug 100. Tagging equipment and other downhole tools may then be able to travel through the openings in wiper plug 100 and through cavity 20 to access the wellbore zones downhole of wiper plug 100. In some examples, a cement disposed downhole of the wiper plug 100 may be tagged with tagging equipment to determine the location and/or strength of the cement.

In some optional examples, uphole breakable covering 30 may be replaced with an uphole rupturable covering that is analogous in function to the downhole rupturable covering 105. In said examples, both the uphole rupturable covering and the downhole rupturable covering 105 may be ruptured at a desired pressure differential. The uphole rupturable covering and the downhole rupturable covering 105 may be configured to rupture at the same or a different pressure differential.

Figure 3:
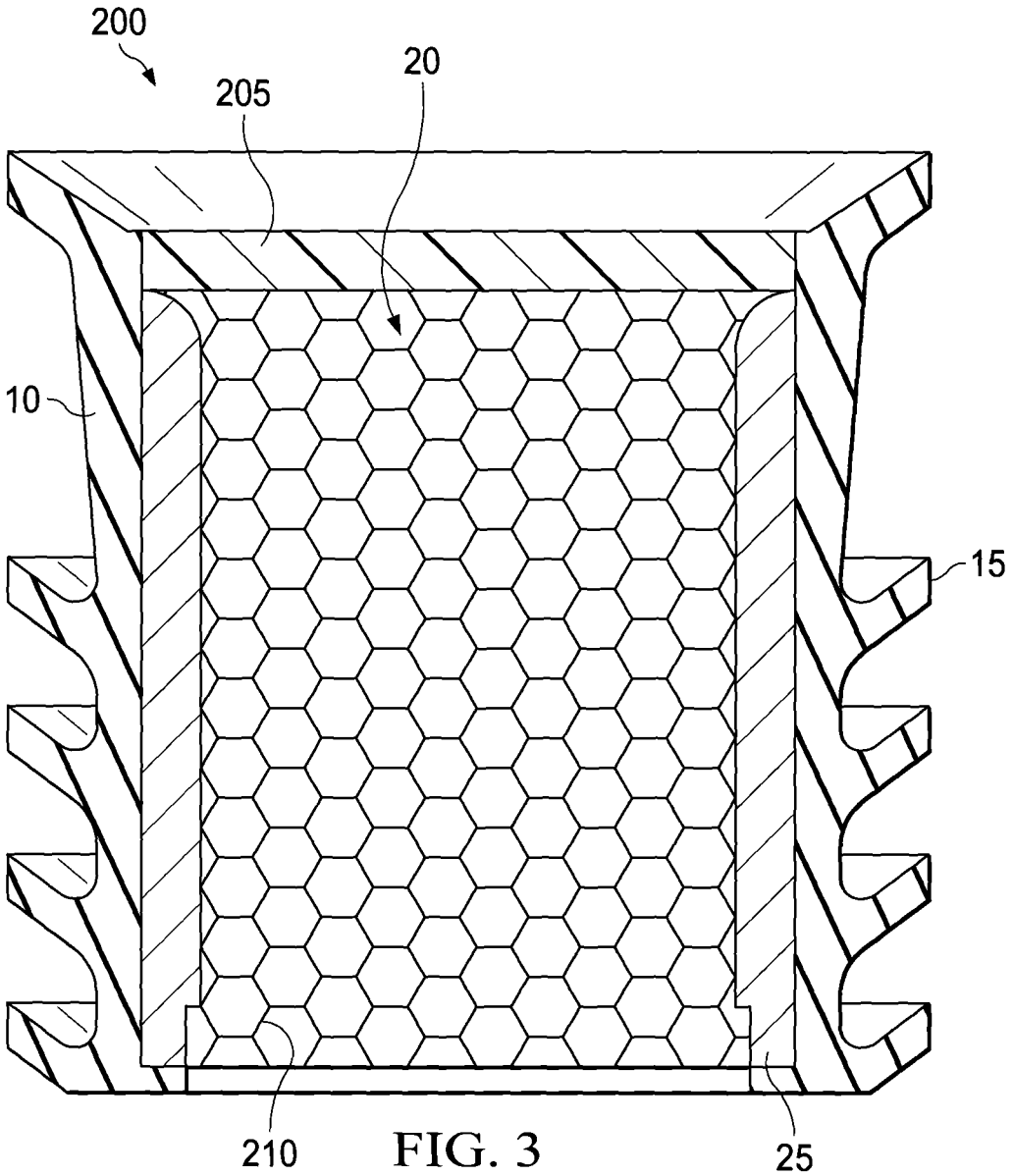
FIG. 3 is a cross-section schematic illustrating another example wiper plug in accordance with the examples disclosed herein.

FIG. 3 is a cross-section schematic illustrating another example of a wiper plug, generally 200. As with the wiper plug 5 of FIG. 1, wiper plug 200 comprises a molded body 10 having a plurality of exterior wipers 15, a cavity 20, and a support 25. As described in FIG. 1, the sides of the molded body 10 of the wiper plug 200 are designed to comprise as small of a width as possible so as to allow the diameter of the cavity 20 to be as large as possible.

The wiper plug 200 further comprises an uphole rupturable covering 205. Uphole rupturable covering 205 may comprise any rupturable material or structure that may rupture and fail at a threshold pressure differential. As such, the uphole rupturable covering 205 may fail at a specific wellbore depth or if an increased pressure is applied to the uphole rupturable covering 205 via a fluid or by pressuring up the wellbore via any sufficient pressuring operation. The uphole rupturable covering 205 may be a rupture disc, pressure safety disc, burst disc, bursting disc, burst diaphragm, or more generally, any non-reclosing pressure relief device. The uphole rupturable covering 205 may comprise metal, plastic, or any material or layerable material which may be ruptured by a change in pressure.

The wiper plug 200 additionally comprises a core of a honeycomb material 210 disposed within cavity 20. Honeycomb material 210 is a material having a honeycomb structure and may, in some optional examples, be layered between sheets of other materials, including sheets of solid materials. Honeycomb material 210 is configured to be a non-reversible compressible material. As such, honeycomb material 210 does not return to its original shape upon collapse. Examples of materials used to produce the honeycomb material 210 include, but are not limited to, metals, metal alloys, plastics, composites thereof, and combinations thereof. Specific examples may include aluminum, aluminum alloys, or fiberglass. The honeycomb material 210 may fill all or a portion of cavity 20. The honeycomb material 210 may be positioned in the cavity 20 such that it is supported between support 25 and uphole rupturable covering 205 and may maintain its position within cavity 20 without a downhole covering (e.g., downhole breakable covering 35 as illustrated in FIG. 1 or downhole rupturable covering 105 as illustrated in FIG. 2). In alternative examples, a downhole breakable covering 35 as illustrated in FIG. 1 or a downhole rupturable covering 105 as illustrated in FIG. 2 may be used to provide a downhole covering for wiper plug 200 and the honeycomb material 210 may be supported thereon.

When desired for use, the uphole rupturable covering 205 may be ruptured at any time. The honeycomb material 210 may be compressed by an increase in pressure, for example contact with a fluid or an increase in wellbore pressure. In some examples, the honeycomb material 210 may contact a downhole fluid (e.g., a cement) which may enter cavity 20 of wiper plug 200 from the downhole opening. Pressure applied from the downhole fluid may compress the honeycomb material 210. The honeycomb material 210 may be configured to be non-reversible compressible, as such the honeycomb material 210 may be collapsed permanently. Upon collapse, the honeycomb material 210 may be removed from the cavity 20 when collapsed or may be collapsed sufficiently to allow downhole tools such as cement tagging equipment to pass through cavity 20. Tagging equipment and other downhole tools may then be able to travel through the openings in the wiper plug 200 and through the cavity 20 to access the wellbore zones downhole of the wiper plug 200. In some examples, a cement disposed downhole of wiper plug 200 may be tagged with tagging equipment to determine the location and/or strength of the cement.

Figure 4:
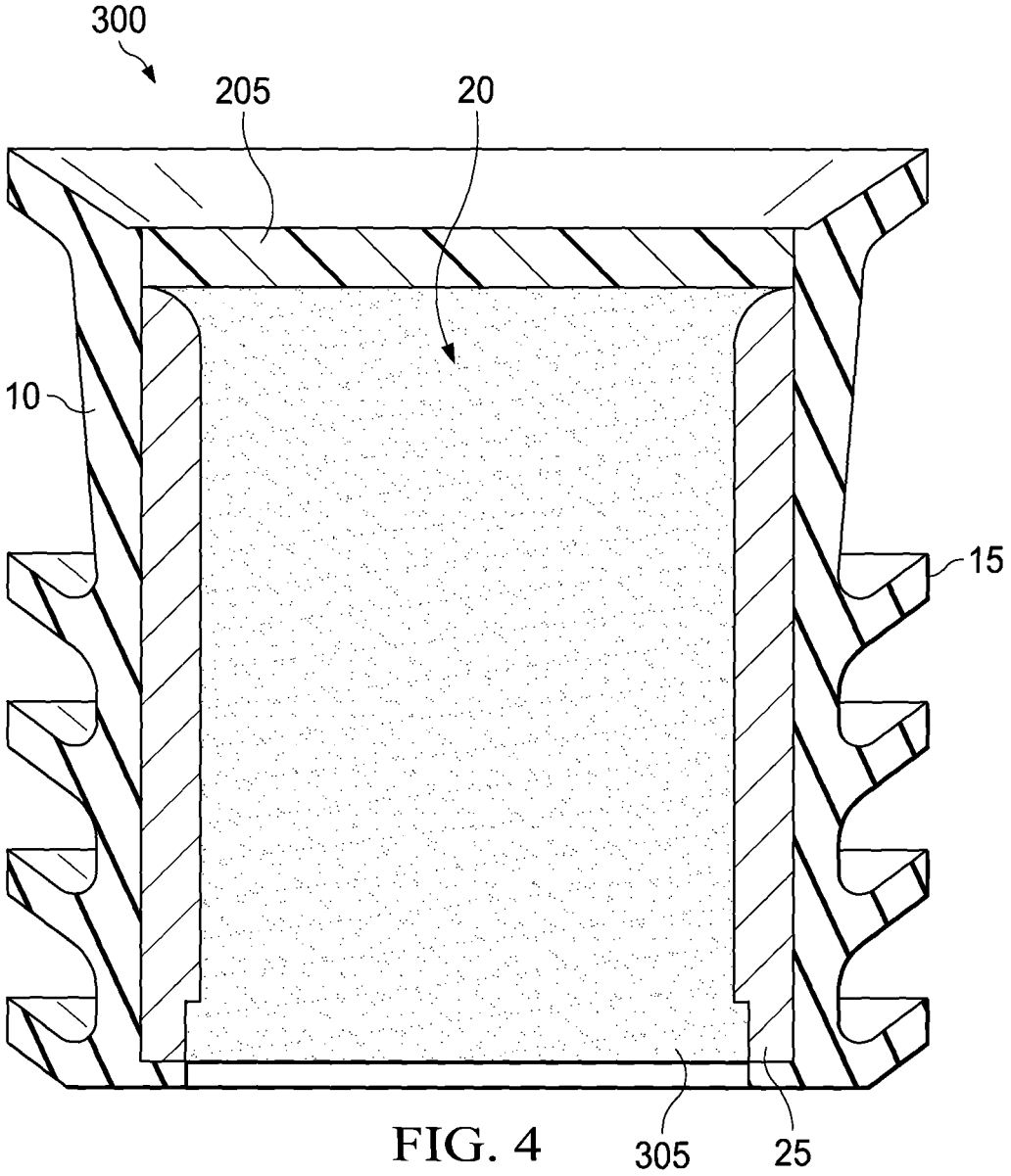
FIG. 4 is a cross-section schematic illustrating another example wiper plug in accordance with the examples disclosed herein.

FIG. 4 is a cross-section schematic illustrating another example wiper plug, generally 300. As with the wiper plug 200 of FIG. 3, wiper plug 300 comprises a molded body 10 having a plurality of exterior wipers 15, a cavity 20, a support 25, and an uphole rupturable covering 205. As described in FIG. 3, the sides of the molded body 10 of the wiper plug 300 are designed to comprise as small of a width as possible so as to allow the diameter of the cavity 20 to be as large as possible.

The wiper plug 300 additionally comprises a core of a foam material 305 disposed within the cavity 20. The foam material 305 is a material that has been foamed to have gas (e.g., air) trapped within a matrix of another material. The foam material 305 is configured to be a non-reversible compressible material. As such, the foam material 305 does not return to its original shape upon collapse since the matrix is physically damaged. Generally, examples of materials used to produce the foam material 305 include brittle materials. Specific examples may include but are not limited to, cements, glass, hardened plastic, ceramics, composites thereof, and combinations thereof. The foam material 305 may fill all or a portion of cavity 20. The foam material 305 may be positioned in cavity 20 such that it is supported between support 25 and uphole rupturable covering 205 and may maintain its position within cavity 20 without a downhole covering (e.g., downhole breakable covering 35 as illustrated in FIG. 1 or downhole rupturable covering 105 as illustrated in FIG. 2). In alternative examples, a downhole breakable covering 35 as illustrated in FIG. 1 or downhole rupturable covering 105 as illustrated in FIG. 2 may be used to provide a downhole covering for the wiper plug 300 and the foam material 305 may be supported thereon.

When desired for use, the uphole rupturable covering 205 may be ruptured at any time. The foam material 305 may be compressed by an increase in pressure (e.g., contact with a fluid or an increase in wellbore pressure). In some examples, the foam material 305 may contact a downhole fluid (e.g., a cement) which may enter cavity 20 of the wiper plug 300 from the downhole opening. Pressure applied from the downhole fluid may compress the foam material 305. The foam material 305 may be configured to be non-reversible compressible, as such the foam material 305 may be collapsed permanently by damaging or breaking down the solid portion of the matrix. Upon collapse, the foam material 305 may be removed from the cavity 20 when collapsed or may be collapsed sufficiently to allow downhole tools such as cement tagging equipment to pass through cavity 20. Tagging equipment and other downhole tools may then be able to travel through the openings in wiper plug 300 and through cavity 20 to access the wellbore zones downhole of wiper plug 300. In some examples, a cement disposed downhole of wiper plug 300 may be tagged with tagging equipment to determine the location and/or strength of the cement.

FIGS. 3 and 4 describe the use of non-reversible compressible materials to fill cavity 20. In addition to honeycomb material 210 and foam material 305, other non-reversible compressible materials may also be used. In some examples, composite materials may be used. For example, a matrix comprising hollow bubbles may be used. The hollow bubbles may be made from glass, plastic, ceramics, or any sufficient bubble membrane material that is non-reversible compressible. The compressible bubbles would collapse under sufficient pressure, allowing the cavity 20 to be accessed. The bubbles are embedded in a brittle matrix material including, but not limited to, cement, plastic, ceramic, glass, or any combination thereof.

Figure 5:
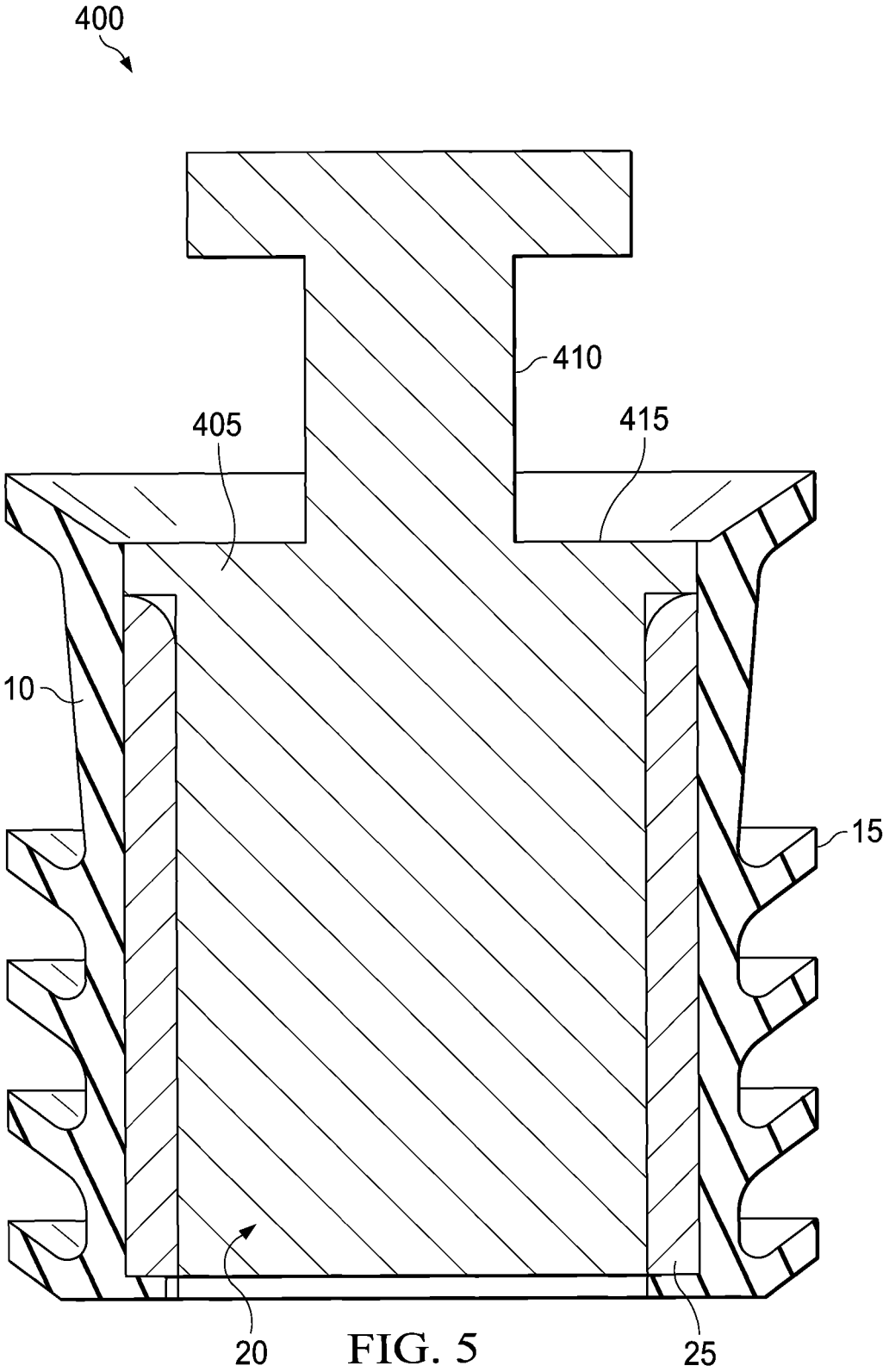
FIG. 5 is a cross-section schematic illustrating another example wiper plug in accordance with the examples disclosed herein.

FIG. 5 is a cross-section schematic illustrating another example wiper plug, generally 400. As with the wiper plug 5 of FIG. 1, wiper plug 400 comprises a molded body 10 having a plurality of exterior wipers 15, a cavity 20, and a support 25. As described in FIG. 1, the sides of the molded body 10 of the wiper plug 400 are designed to comprise as small of a width as possible so as to allow the diameter of the cavity 20 to be as large as possible.

The wiper plug 400 further comprises a solid core 405 having a neck 410 that extends in the uphole direction. The solid core 405 is disposed within the cavity 20. The solid core 405 may comprise a lip 415 on the profile of the solid core 405 that prevents the wiper plug 400 from sliding in the downhole direction as the wiper plug 400 is pumped in the wellbore. The solid core 405 may comprise any material sufficient for forming the core of the wiper plug 400. Examples of materials may include, but are not limited to, metals, metal alloys, plastics, composites thereof, or combinations thereof. Specific examples include aluminum alloys or steel. In some examples, the core may also have the shape of a pipe with a geometry suitable for engaging with a solid bar type fishing device.

When desired for use, the neck 410 may be fished using any suitable fishing mechanism or other type of wireline retrieval. The neck 410 may then be used to pull the solid core 405 uphole and out of the wiper plug 400 creating an opening through the cavity 20. Tagging equipment and other downhole tools may then be able to travel through the openings in wiper plug 400 and through cavity 20 to access the wellbore zones downhole of the wiper plug 400. In some examples, a cement disposed downhole of wiper plug 400 may be tagged with tagging equipment to determine the location and/or strength of the cement. In further examples, the solid core 405 may be reused and reinserted into another wiper plug 400.

It is to be understood that although FIGS. 1-5 describe the removal of the core of various examples of wiper plugs for the purpose of passing tagging devices or downhole tools through the wiper plugs, in some applications the core of the wiper plugs may be removed so as to allow fluid to flow through the wiper plugs to contact other zones of the wellbore or other fluids disposed within the wellbore. For example, the core of a wiper plug may be removed to allow water to contact a cement downhole of the wiper plug.

A tagging device may include a bar, a spear-like body, a pipe, or any other object able to pass through the body of any of the various wiper plug examples after the core has been removed. The tagging device may be used to remove or break down the core before the tagging operation. The tagging device may be dropped in the well from any height ranging from surface to a minimal distance above the expected location of the wiper plug, or it may be lowered by means of drill pipe, coiled tubing, wireline or any other deployment method. It may be applied to break down the core by impact, by mass (gravity), or by force obtained with any mechanical device.

Figure 6:
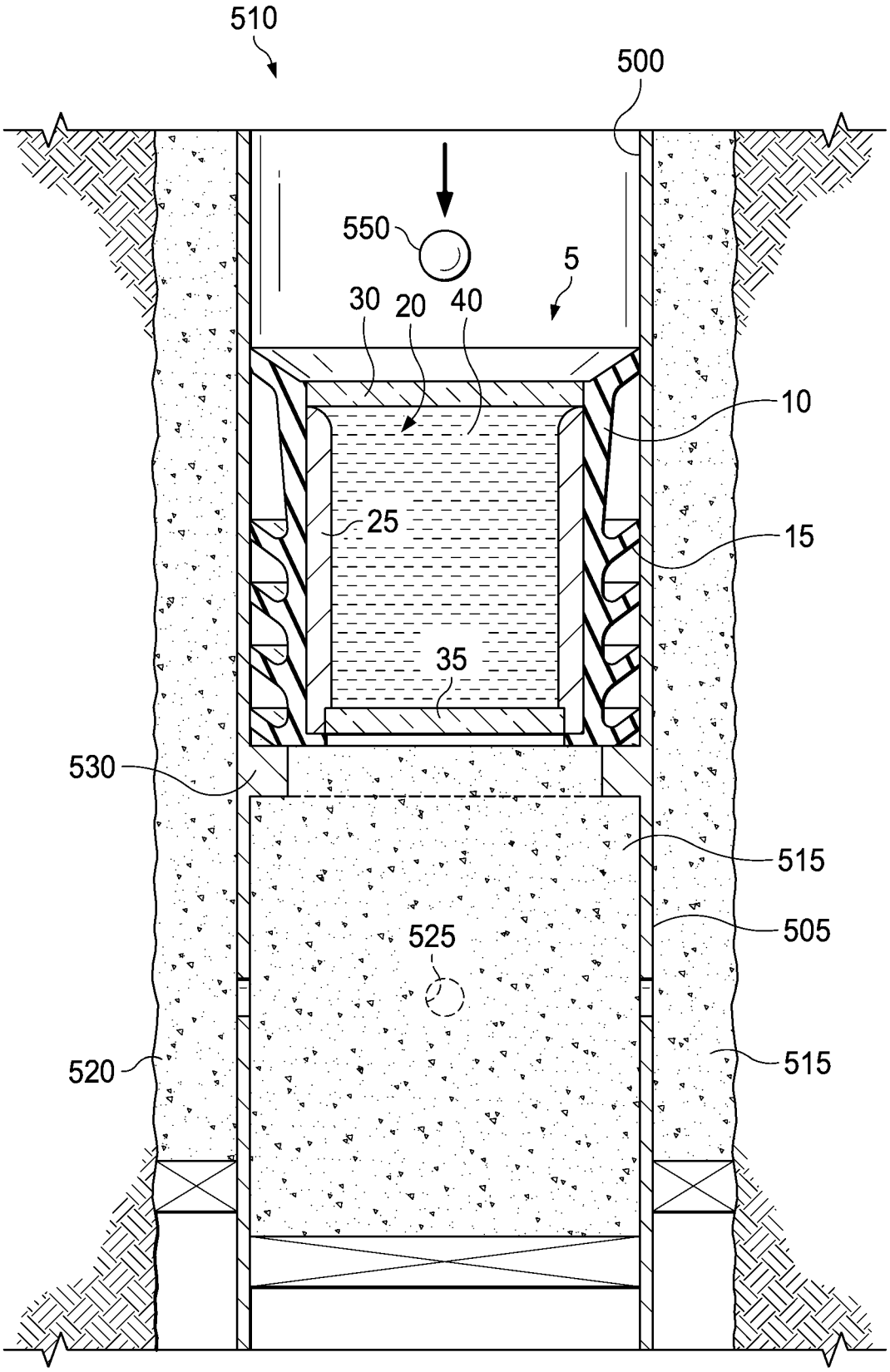
FIG. 6 is a cross-section schematic illustrating the use of the wiper plug of FIG. 1 in accordance with the examples disclosed herein.

FIG. 6 is a cross-section illustrating the use of the example wiper plug 5 of FIG. 1 in a wellbore 505. As illustrated, wiper plug 5 has been introduced into a tubular 500 within a wellbore 505 penetrating a subterranean formation 510. Prior pumped cement 515 has filled a portion of the tubular 500 and entered into the annulus 520 via perforation 525. Wiper plug 5 may rest on a plug landing profile 530. Alternatively, wiper plug 5 may rest on the solidified cement or other sealant or fluid after placement without any landing profile.

When the core fluid 40 is to be removed from the wiper plug 5, a projectile 550 may be released from uphole to contact uphole breakable covering 30 and downhole breakable covering 35. In some alternative embodiments, uphole breakable covering 30 may be substituted with an uphole rupturable covering which may be ruptured at a desired pressure differential as described above. In some further alternative embodiments, downhole breakable covering 35 may be substituted with a downhole rupturable covering which may be ruptured at a desired pressure differential as described above. Alternatively, instead of a projectile, any other suitable device may be lowered into the tubular at any velocity considered suitable to break the core.

Figure 7:
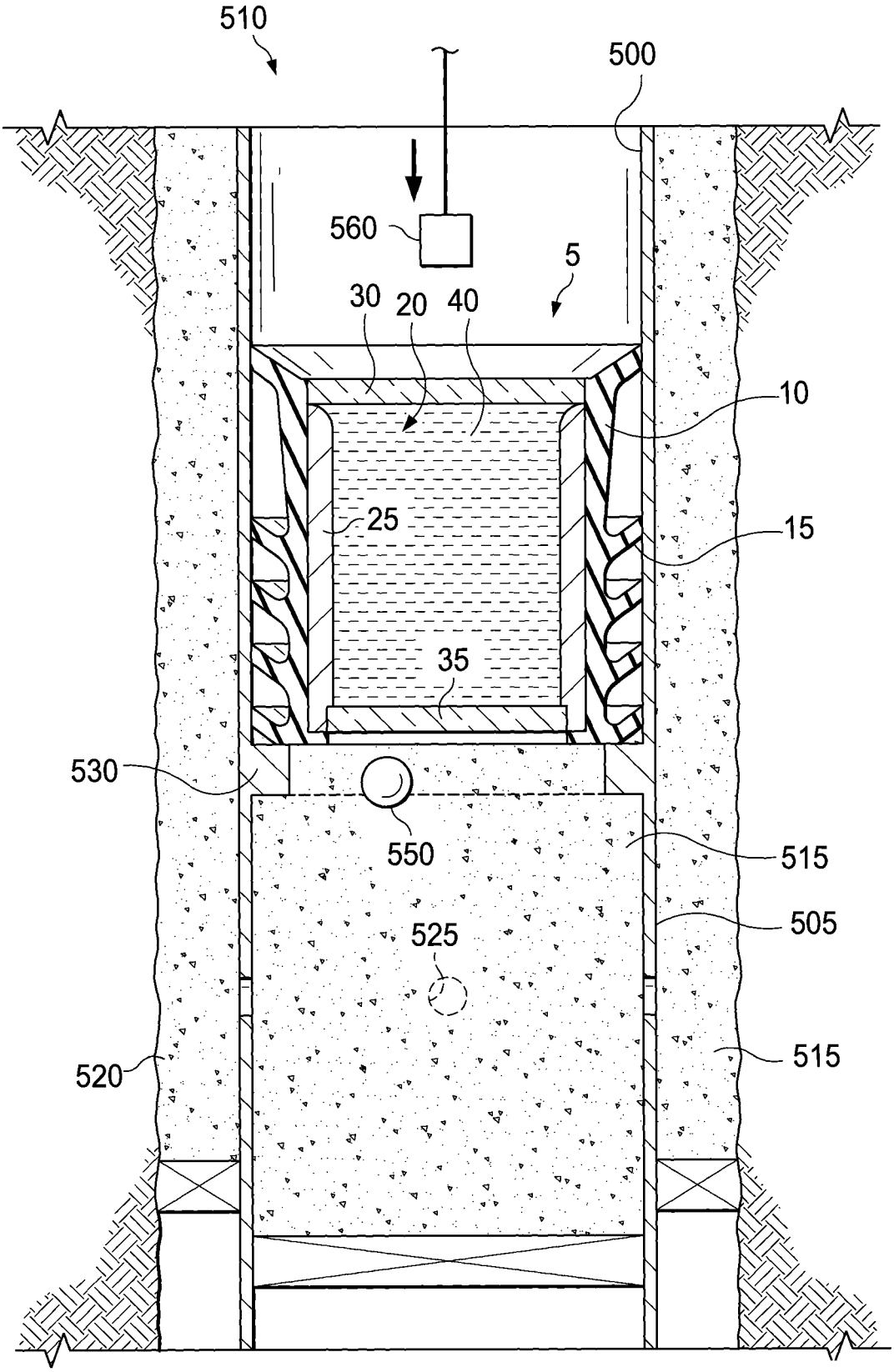
FIG. 7 is a cross-section schematic illustrating the removal of the core of the wiper plug of FIG. 1 in accordance with examples disclosed herein.

FIG. 7 is a cross-section illustrating the removal of the core fluid 40 from the wiper plug 5 of FIG. 6. As illustrated, projectile 550 has broken uphole breakable covering 30 and downhole breakable covering 35, and the core fluid 40 may drain downhole, be displaced uphole, or be penetrated by the tagging device or downhole tool 560. Downhole tool 560 may then be passed through the open cavity 20 within wiper plug 5 to perform a downhole operation, such as, for example, tagging.

Figure 8:
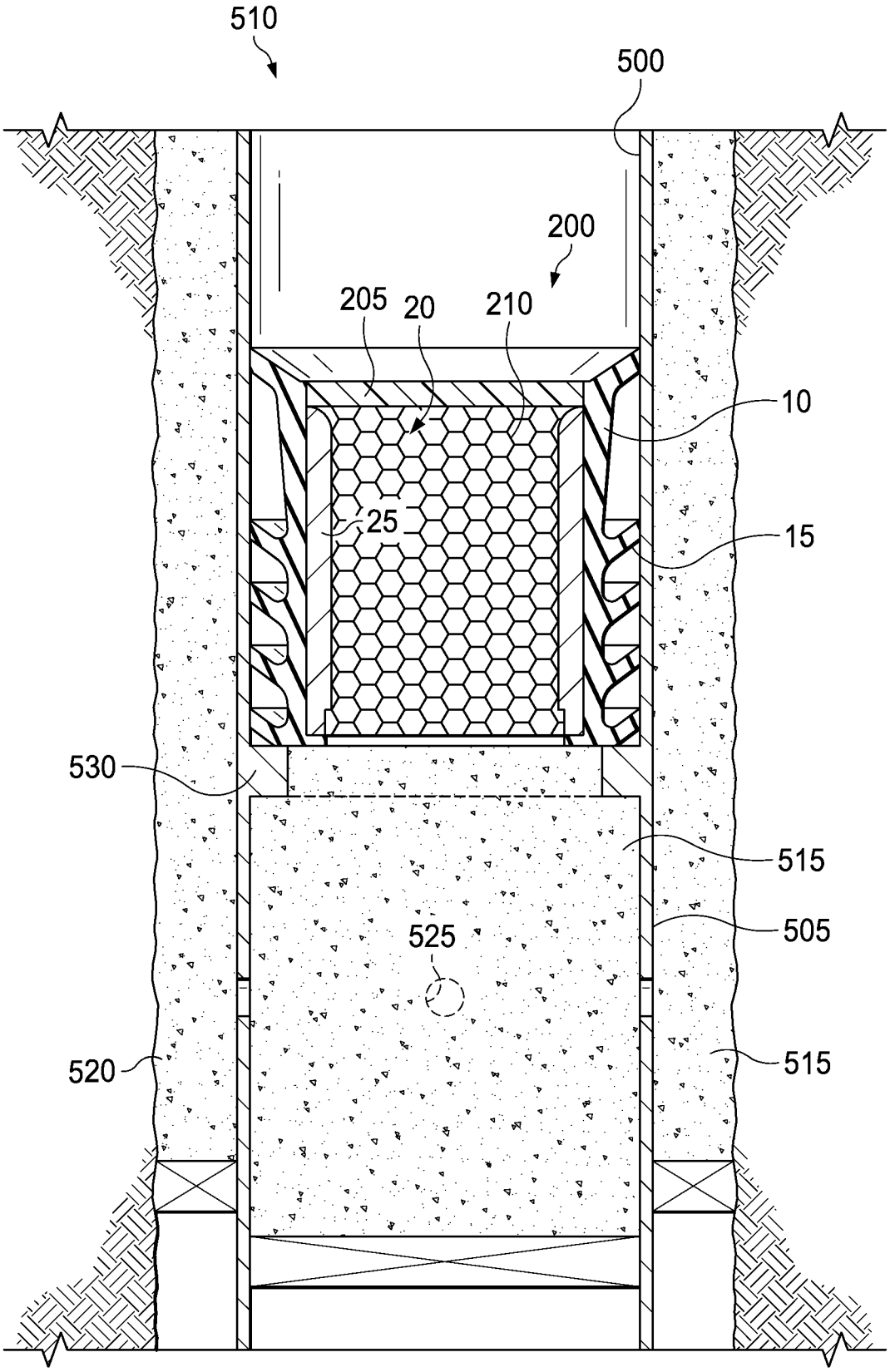
FIG. 8 is a cross-section schematic illustrating the use of the wiper plug of FIG. 3 in accordance with the examples disclosed herein.

FIG. 8 is a cross-section illustrating the use of an example wiper plug 200 of FIG. 3 in a wellbore 505. As illustrated, wiper plug 200 has been introduced into a tubular 500 within a wellbore 505 penetrating a subterranean formation 510. Prior pumped cement 515 has filled a portion of the tubular 500 and entered into the annulus 520 via perforation 525. Wiper plug 200 may rest on a plug landing profile 530.

When desired for use, the uphole rupturable covering 205 may be ruptured. The honeycomb material 210 comprising the core of the wiper plug 200 may not possess sufficient support from the cement underneath, as the honeycomb material 210 is non-reversible compressible and may be collapsed under sufficient pressure.

Figure 9:
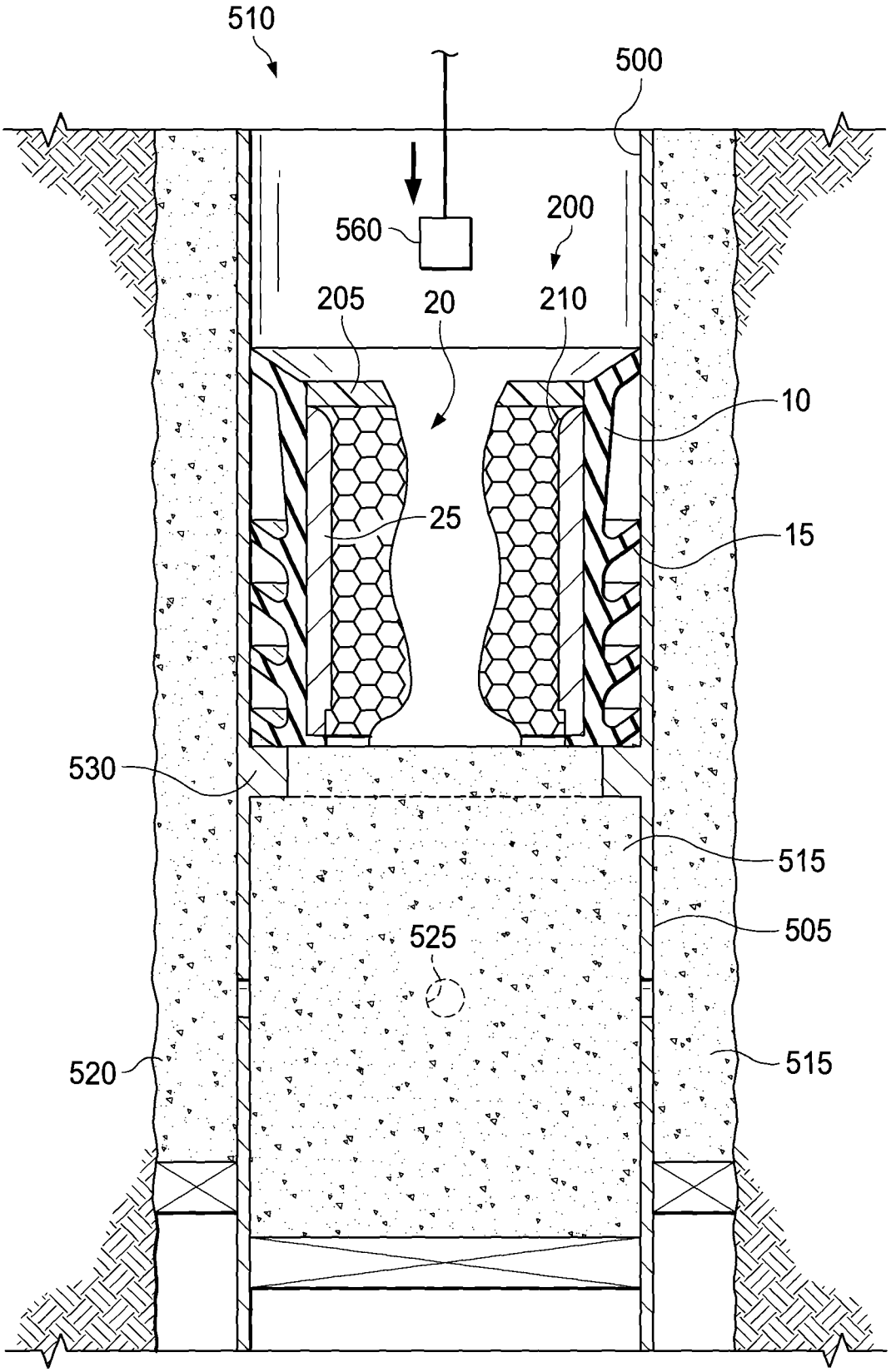
FIG. 9 is a cross-section schematic illustrating the removal of the core of the wiper plug of FIG. 3 in accordance with examples disclosed herein.

FIG. 9 is a cross-section illustrating the removal of the honeycomb material 210 from the wiper plug 200 of FIG. 8. As illustrated, uphole rupturable covering 205 has ruptured from the pressure differential. Honeycomb material 210 has collapsed from the pressure of the cement underneath it and the increased wellbore pressure. Downhole tool 560 may then be passed through the open cavity 20 within wiper plug 200 to perform a downhole operation.

Figure 10:
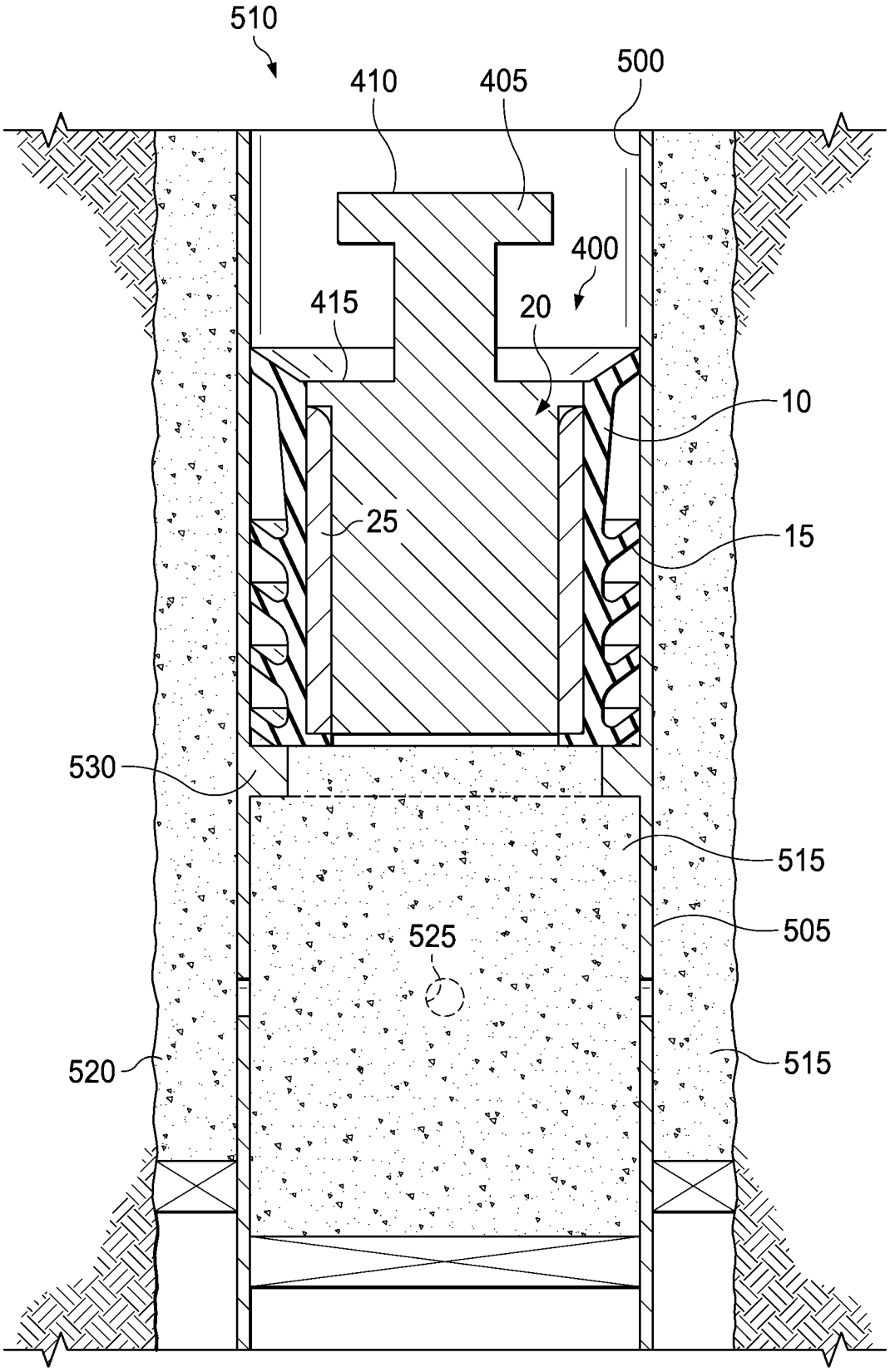
FIG. 10 is a cross-section schematic illustrating the use of the wiper plug of FIG. 5 in accordance with the examples disclosed herein.

FIG. 10 is a cross-section illustrating the use of an example wiper plug 400 of FIG. 5 in a wellbore 505. As illustrated, wiper plug 400 has been introduced into a tubular 500 within a wellbore 505 penetrating a subterranean formation 510. Prior pumped cement 515 has filled a portion of the tubular 500 and entered into the annulus 520 via perforation 525. Wiper plug 400 may rest on a plug landing profile 530.

Figure 11:
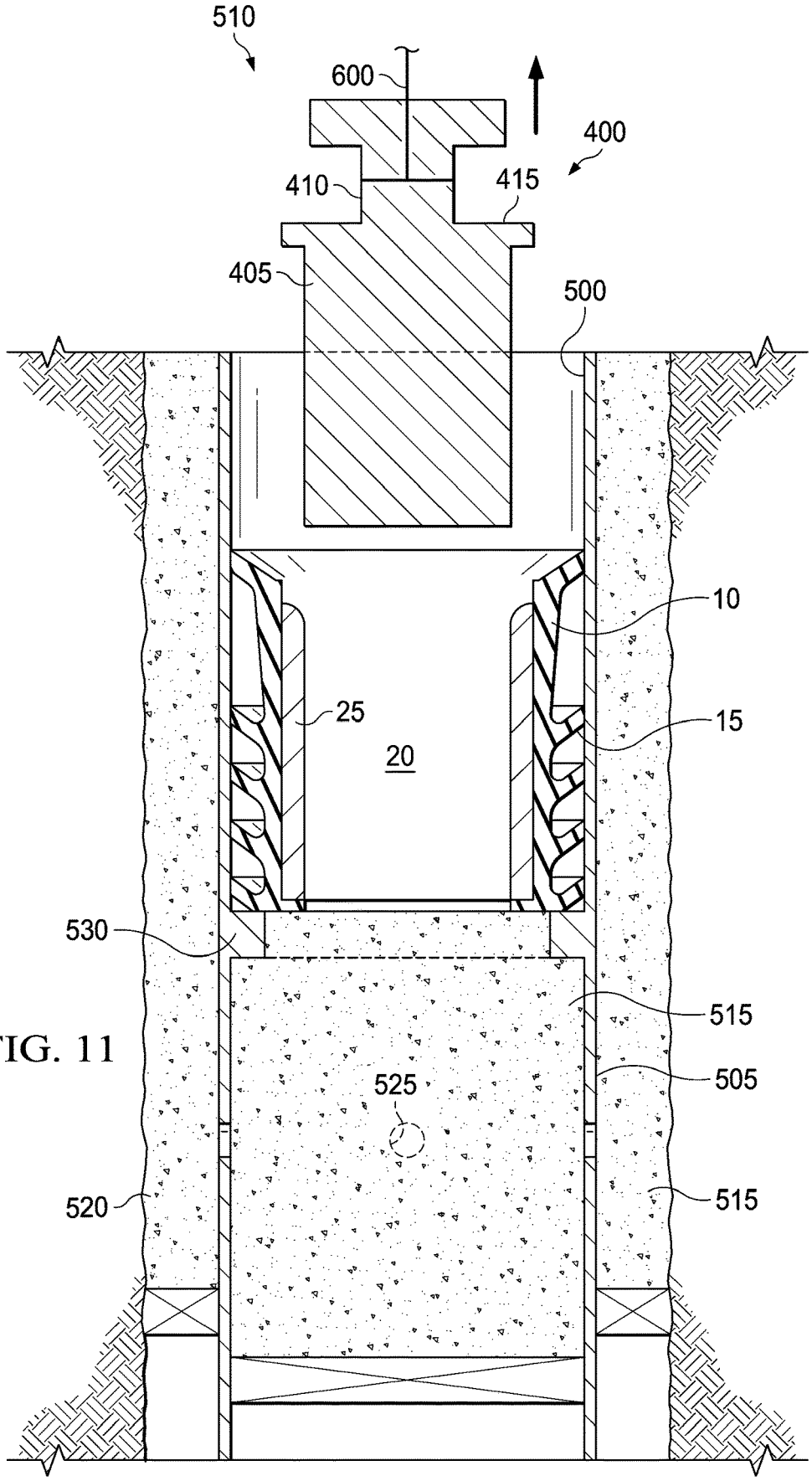
FIG. 11 is a cross-section schematic illustrating the removal of the core of the wiper plug of FIG. 5 in accordance with examples disclosed herein.

FIG. 11 is a cross-section illustrating the removal of the solid core 405 from the wiper plug 400 of FIG. 10. As illustrated, a wireline 600 or other retrieval means may fish for the neck 410 of the solid core 405. The wireline 600 may then be used to pull the solid core 405 out of cavity 20 and return it uphole. A downhole tool (not illustrated) may then be passed through the open cavity 20 within wiper plug 400 to perform a downhole operation.

As such, the core of the example wiper plugs illustrated in FIGS. 1-11 may be removed without drilling through the wiper plug. Further, the core of the example wiper plugs may be removed without the chemical degradation of any component of the wiper plugs. Moreover, the core of the wiper plug may be removed while the remainder of the wiper plug is left in the wellbore.

Figure 12:
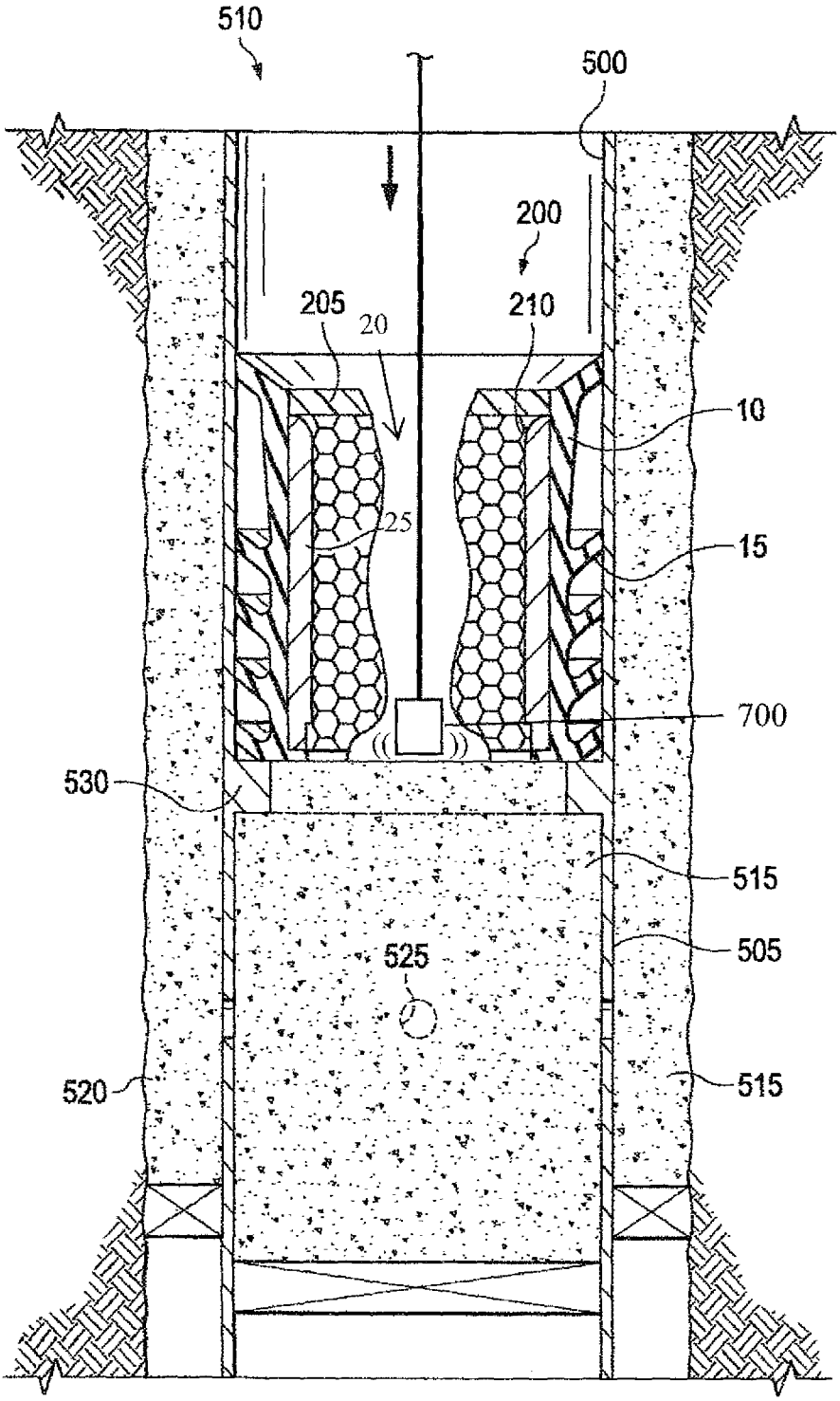
FIG. 12 is a cross-section schematic illustrating a cement tagging operation of the wiper plug of FIG. 3 in accordance with the examples disclosed herein.

FIG. 12 is a cross-section illustrating a cement tagging tool 700 performing a cement tagging operation in the example illustrated previously in FIG. 9. After collapse of the honeycomb material 210, cement tagging tool 700 is passed through cavity 20 to perform a cement tagging operation on the cement downhole of the wiper plug 200.

It should be clearly understood that the examples illustrated by FIGS. 1-12 are merely general applications of the principles of this disclosure in practice, and a wide variety of other examples are possible. Therefore, the scope of this disclosure is not limited in any manner to the details of FIGS. 1-12 described herein.

It is also to be recognized that the disclosed example wiper plugs may also directly or indirectly affect the various downhole equipment and tools that may come into direct or indirect contact with the example wiper plugs during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIGS. 1-7.

Provided are wiper plugs with removable cores in accordance with the disclosure and the illustrated FIGs. An example wiper plug with a removable core comprises a molded body, a wiper, a cavity through the interior of the molded body, a support disposed in the cavity, and the removable core disposed in the cavity. The wiper plug may further comprise an uphole covering. The uphole covering may be an uphole breakable covering or an uphole rupturable covering. The wiper plug may further comprise a downhole covering. The downhole covering may be a downhole breakable covering or a downhole rupturable covering. The core may be solid and comprise a neck configured to be fished. The core may comprise a fluid. The core may comprise a honeycomb material. The core may comprise a matrix with bubbles.

Provided are methods for removing the core of a wiper plug in accordance with the disclosure and the illustrated FIGs. An example method comprises introducing the wiper plug comprising: a molded body, a wiper, a cavity through the interior of the molded body, a support disposed in the cavity, and a removable core disposed in the cavity. The method may further comprise removing the core of the wiper plug without drilling through the wiper plug, and leaving the remainder of the wiper plug in the wellbore. The removal of the core may comprise breaking an uphole breakable covering of the wiper plug and draining a fluid from the cavity. The removal of the core may comprise rupturing an uphole rupturable covering of the wiper plug and draining a fluid from the cavity. The removal of the core may comprise rupturing an uphole rupturable covering of the wiper plug and compressing a honeycomb material. The removal of the core may comprise rupturing an uphole rupturable covering of the wiper plug and compressing a matrix with bubbles. The removal of the core may comprise fishing a solid core comprising a neck and retrieving the solid core from the wiper plug. The method may further comprise deploying a cement tagging tool through the wiper plug. The method may further comprise tagging a cement with the cement tagging tool.

Provided are systems for removing the core of a wiper plug in accordance with the disclosure and the illustrated FIGs. An example system comprises the wiper plug comprising: a molded body, a wiper, a cavity through the interior of the molded body, a support disposed in the cavity, and the removable core disposed in the cavity; a tubular in which the wiper plug is disposed; and a cement located downhole of the wiper plug. The removable core may comprise a fluid, a honeycomb material, a foam, a matrix with bubbles, or a solid material comprising a neck. The wiper plug may further comprise an uphole breakable covering or an uphole rupturable covering. The wiper plug may further comprise a downhole covering. The downhole covering may be a downhole breakable covering or a downhole rupturable covering. The core may be solid and comprise a neck configured to be fished. The core may comprise a fluid. The core may comprise a honeycomb material. The core may comprise a matrix with bubbles.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A wiper plug with a removable core comprising:

a molded body having an interior void disposed therethrough, a wiper, a cavity through the interior of a support, the support disposed circumferentially within the interior void of the molded body and having the cavity passing through the support, and the removable core disposed in the cavity passing through the support.

2. The wiper plug of claim 1, further comprising an uphole covering.

3. The wiper plug of claim 2, wherein the uphole covering is an uphole breakable covering or an uphole rupturable covering.

4. The wiper plug of claim 1, further comprising a downhole covering.

5. The wiper plug of claim 4, wherein the downhole covering is a downhole breakable covering or a downhole rupturable covering.

6. The wiper plug of claim 1, wherein the core is solid and comprises a neck configured to be fished.

7. The wiper plug of claim 1, wherein the core comprises a fluid.

8. A method for removing the core of a wiper plug, the method comprising:

introducing the wiper plug comprising:

a molded body having an interior void disposed therethrough, a wiper, a cavity through the interior of a support, the support disposed circumferentially within the interior void of the molded body and having the cavity passing through the support, and a removable core disposed in the cavity passing through the support;

removing the core of the wiper plug without drilling through the wiper plug; and leaving the remainder of the wiper plug in the wellbore.

9. The method of claim 8, wherein the removing the core comprises breaking an uphole breakable covering of the wiper plug and draining a fluid from the cavity.

10. The method of claim 8, wherein the removing the core comprises rupturing an uphole rupturable covering of the wiper plug and draining a fluid from the cavity.

11. The method of claim 8, wherein the removing the core comprises fishing a solid core comprising a neck and retrieving the solid core from the wiper plug.

12. The method of claim 8, further comprising deploying a cement tagging tool through the wiper plug.

13. The method of claim 12, further comprising tagging a cement with the cement tagging tool.

14. A system for removing a core from a wiper plug, the system comprising:

the wiper plug comprising:

a molded body having an interior void disposed therethrough, a wiper, a cavity through the interior of a support, the support disposed circumferentially within the interior void of the molded body and having the cavity passing through the support, and the removable core disposed in the cavity passing through the support;

a tubular in which the wiper plug is disposed; and a cement located downhole of the wiper plug.

15. The system of claim 14, wherein the wiper plug further comprises an uphole breakable covering or an uphole rupturable covering.

16. The system of claim 14, wherein the wiper plug further comprises a downhole breakable covering or a downhole rupturable covering.

17. The system of claim 14, wherein the core is solid and comprises a neck configured to be fished.

18. The system of claim 17, further comprising a fishing tool to retrieve the core.

19. The system of claim 14, further comprising a cement tagging tool configured to tag a cement through the wiper plug.

20. The system of claim 14, wherein the core comprises a fluid.

* * * * *